United States Patent [19]

Best et al.

[11] Patent Number: 4,656,704

[45] Date of Patent: Apr. 14, 1987

[54] AUTOMATIC COLLAR SEPARATION

[75] Inventors: Robert H. Best, Greensboro; Vernon T. Daniel, Oak Ridge, both of N.C.

[73] Assignee: Burlington Industries, Inc., Greensboro, N.C.

[21] Appl. No.: 811,746

[22] Filed: Dec. 20, 1985

[51] Int. Cl.[4] ..... D04B 19/00

[52] U.S. Cl. ..... 28/170

[58] Field of Search ..... 28/170; 66/147

[56] References Cited

U.S. PATENT DOCUMENTS

| | | | |
|---|---|---|---|
| 2,822,602 | 2/1958 | King | 28/170 |
| 2,921,359 | 1/1960 | Cotumaccio . | |
| 2,926,416 | 3/1960 | Feldstein et al. . | |
| 3,166,261 | 1/1965 | Loflen . | |
| 3,298,077 | 1/1967 | Russak . | |
| 3,797,080 | 3/1974 | Rockman et al. . | |
| 3,813,738 | 6/1974 | Hucknall et al. . | |
| 3,893,213 | 7/1975 | Rockman et al. . | |

FOREIGN PATENT DOCUMENTS

| | | | |
|---|---|---|---|
| 51-3829 | 2/1976 | Japan | 28/170 |

*Primary Examiner*—Robert R. Mackey

*Attorney, Agent, or Firm*—Nixon & Vanderhye

[57] ABSTRACT

A method and apparatus provide for the effective automatic separation of two textile blanks, such as collars for knit sport shirts. Blanks are connected together by connector threads which extend generally in a first dimension. The blanks rest on a support surface, and are engaged by a presser foot which moves into contact with them and then moves them horizontally along the support surface to a first position. At the first position, the connector thread is sensed and severed at one edge of the blanks, and at the other edge of the blanks a pair of brushes mounted on a scissors linkage move into engagement with each other to grasp a loop of the connector thread between them. The scissors linkage is then moved in the first dimension away from the blanks to begin unravelling of the connector thread, and then the connector thread is released. As the thread is released it moves into operative association with a hook which pulls the thread through a yarn detector into operative association with a pair of rollers, which then engage the connector thread and unravel it. As the thread is unravelled, an air jet or vacuum acts on it to move it to a disposal area.

24 Claims, 11 Drawing Figures

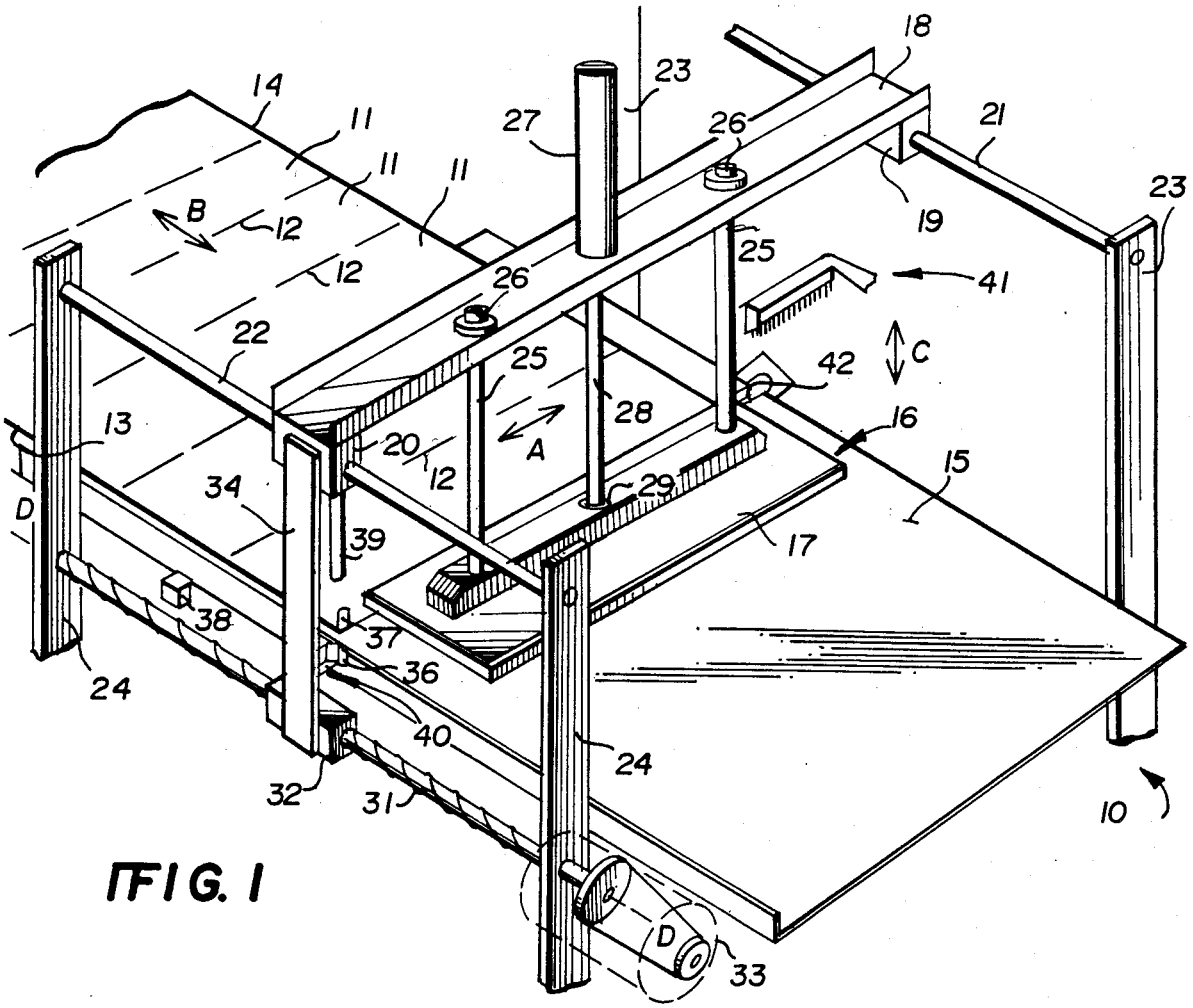
FIG. 1
FIG. 3
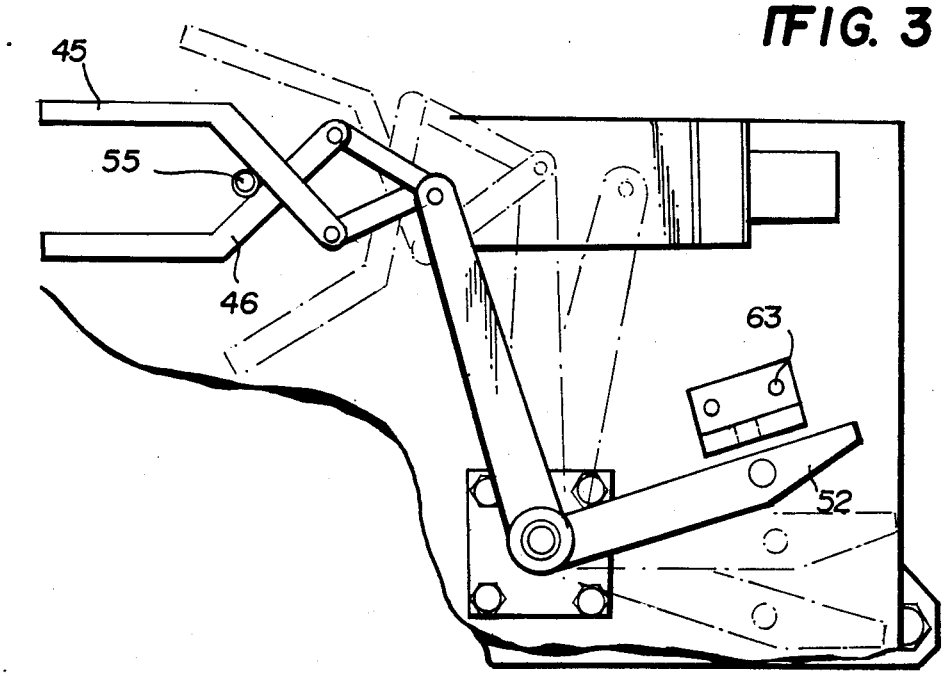

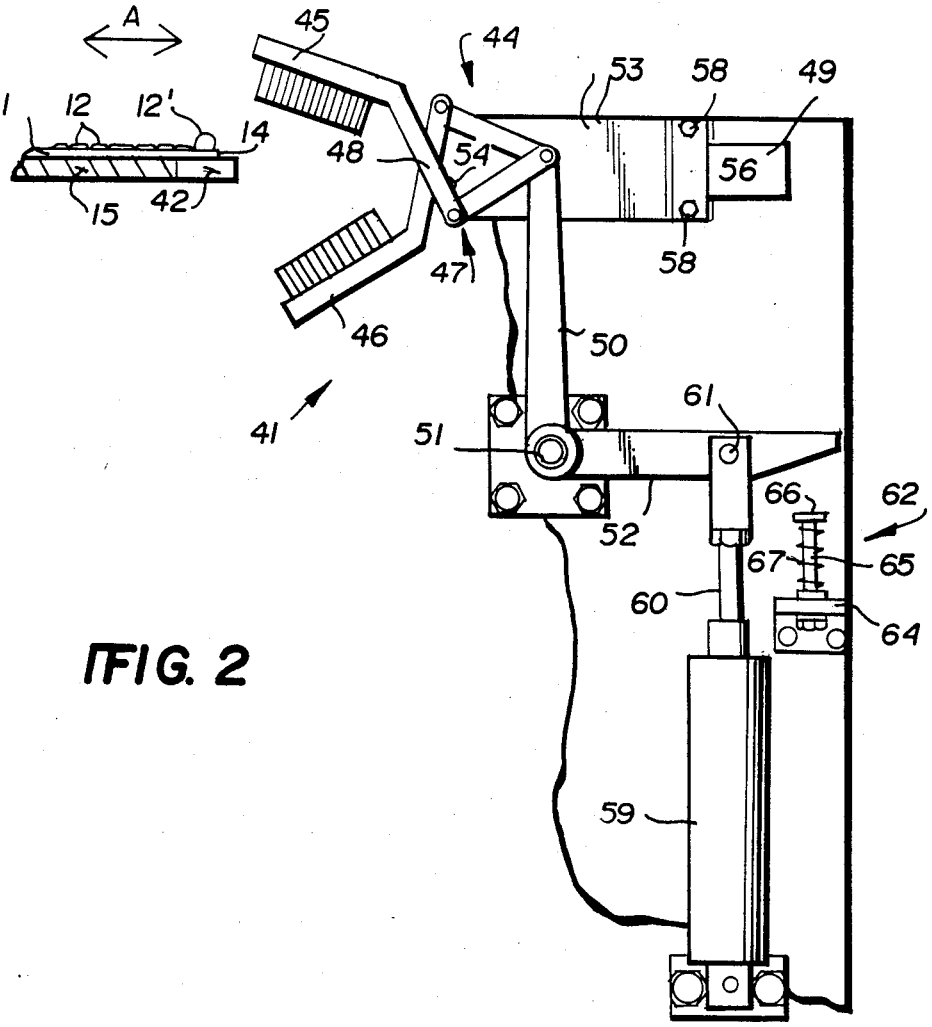
FIG. 2
FIG. 4
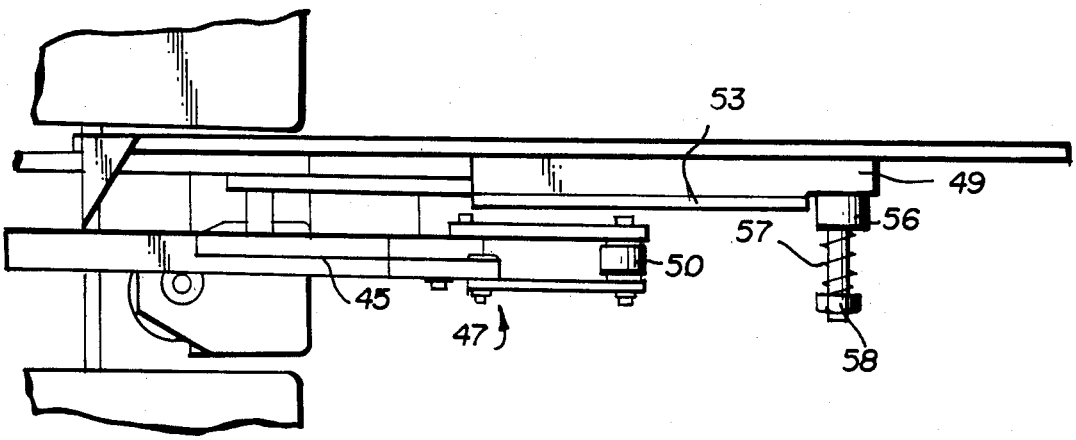

AUTOMATIC COLLAR SEPARATION

BACKGROUND OF THE INVENTION

In the manufacture of many finished textile products, there is occasion to maintain together a number of textile blanks in a web form, and then after treatment of the blanks in the web form to separate them from each other before they are made into a final textile article. The textile blanks are typically connected together by what is commonly referred to as "connector threads" or "separation yarns". The connector threads connect adjacent blanks to each other in such a way that they can be commonly treated together as a web, but so that after a connector thread is severed it may be easily unravelled to thereby effect separation of the textile blanks.

One particular procedure in which textile blanks are commonly maintained together during treatment and subsequently separated is called for in the manufacture of collars for knit sport shirts. After each collar is knitted, and knitted to an adjacent collar with a connector thread, the web of collars is washed, dyed and finished. It is then necessary to effect separation of the collars from each other before sewing them into the final sport shirt. Commercially, this is typically done by hand or in a semi-automatic manner, in which an operator cuts one portion of the connecting thread with a scissors or a hot wire cutter, grabs the connector thread and completely unravels it, or grabs the connector thread and moves it into operative association with a rotating element which then completes the unravelling operation. Due to highly varying production schedules, it is extremely difficult to schedule personnel efficiently to perform the manual operations. Therefore, it is highly desirable to be able to completely automate the textile blanks separating procedure, such as during the manufacture of collars for knits sport shirts.

According to one aspect of the present invention, apparatus is provided for effecting automatic separation of textile blanks connected by a connector thread. The basic components of the apparatus include a structure for moving the textile blanks to a predetermined position, a structure for severing the connector thread at that position, and a structure for automatically grasping the severed connected thread and effecting automatic unravelling of it.

The preferred structure for advancing the textile blanks into a desired position, according to the present invention includes a presser foot and a horizontal support surface. The textile blanks lie on the support surface with first and second edges thereof in a second dimension, generally perpendicular to a first dimension in which the connector thread extends. The presser foot is automatically moved downwardly into contact with a textile blank to press it against the support surface, and then it is moved in the second dimension to slide the textile blanks along the support surface to the desired first position. The fact that the textile blanks have moved to the desired first position is sensed by a photoelectric sensing system, and then a mechanical cutter is automatically actuated to effect severing of the connector thread along a first edge of the blanks.

Substantially simultaneously with the cutting of the connector thread along the first edge of the blanks, a loop of the connector thread is automatically grasped along the second edge of the blanks. It is difficult to be able to automatically grasp a connector thread, and that is a primary reason why prior art systems have required an operator to grab the thread with her/his fingers. However, according to the present invention, the thread is effectively automatically grasped by a pair of brushes which are mounted on a scissors linkage.

The brushes are pivotted into engagement with each other whereby the grasped connector thread between them, and the scissors linkage, is moved in the first dimension away from the support surface. This starts the unravelling process. After the connector thread has been unravelled a small amount, the scissors linkage moves the brushes away from each other whereby the connector thread is released. While the brushes have been moving away from the support surface, a hook has been automatically moved up into a position between the support surface and the brushes, and the hook engages the connector thread after it is released. The hook moves the connector thread through a yarn sensor and then past a pair of rollers, one having a stationary axis and the other having a moveable axis. Once the thread is moved past the rollers, the moveable axis roller moves into operative association with the stationary axis roller to thereby engage the thread and to effect complete unravelling thereof. An air jet, vacuum source, or the like operatively engages the thread after it has been unravelled by the rollers, and moves it to a disposal site.

According to another aspect of the present invention, there is provided a method for automatically separating textile blanks, such as knit sports shirt collars. In the practice of the method, the textile blanks are operatively engaged and automatically moved into a first position. At the first position automatically and substantially simultaneously a connector thread is severed adjacent one edge of the blanks, and grasped adjacent the other end of the blanks. The grasped portion of the connector thread is automatically moved in the first dimension, away from the blanks, and then it is automatically engaged and unravelled completely, and disposed of.

It is a primary object of the present invention to provide an effective apparatus and method for automatically separating textile blanks which are connected together by connector thread. This and other objects of the invention will become clear from an inspection of the detailed description of the invention, and from the appended claims.

BRIEF DESCRIPTION OF THE DRAWINGS

FIG. 1 is a schematic perspective view of exemplary apparatus according to the present invention;

FIG. 2 is a side detailed view of an exemplary connector thread grasping mechanism according to the present invention;

FIG. 3 is a side schematic view of the mechanism of FIG. 2 illustrating movement thereof between grasping and releasing positions;

FIG. 4 is a top view of the apparatus of FIG. 2;

DETAILED DESCRIPTION OF THE DRAWINGS

Figure 5:
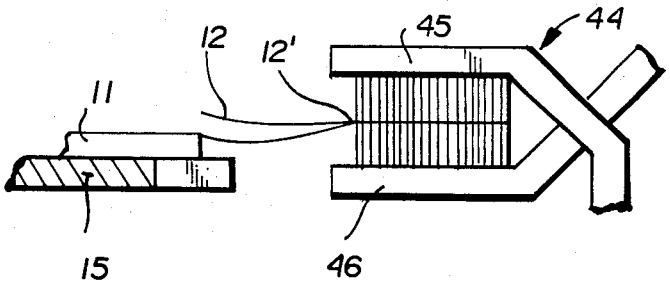
FIGS. 5–7 are schematic side views of exemplary connector thread grasping and unravelling apparatus according to the present invention.

Exemplary apparatus according to the present invention is shown generally by reference numeral 10 in FIG. 1. Apparatus 10 is for separating textile blanks, such as the blanks 11, from each other, the textile blanks being connected in a web form by connector thread 12. In the embodiment illustrated in the drawings the blanks 11 are knit sport shirt collar blanks, and have first and second side edges 13, 14. The connector thread 12 extends generally in a first dimension A, while the edges 13, 14 extend in a dimension B generally perpendicular to the dimension A.

A first major component of the apparatus 10 includes a structure for engaging and advancing the blanks 11. In the exemplary embodiment illustrated in the drawings, such engaging and advancing means comprises a generally flat and horizontal support surface 15 elongated in the dimension B, and on which the blanks 11 lie. The support surface 15 cooperates with a presser foot, shown generally by reference numeral 16. The presser foot includes a flat plate 17 which has dimensions that are generally comparable to the dimensions of a blank 11, and means are provided for mounting presser foot 17 for movement in the dimension B, and for vertical movement toward and away from the support surface 15, that is for movement in dimension C which is generally perpendicular to dimension A.

The presser foot 17 is mounted on a cross bar 18 which has guide rod engaging blocks 19, 20 at opposite ends thereof. The blocks 19, 20 respectively engage guide rods 21, 22, the guide rods being mounted on opposite sides of the support 15 and vertically above the support 15 by the upstanding vertical frame components 23, 24, respectively. The presser foot 17 is mounted to the cross support 18 by guide rods 25 having stop portions 26 at the ends thereof, and which pass through openings (not shown) in the cross bar 18 and are guided as they are moved in the vertical dimension C. Movement of the presser foot 17 in dimension C is effected by the linear actuator 27, which preferably comprises a pneumatic cylinder having a piston rod 28, rod 28 being connected to the presser foot 17 at 29.

The cross bar 18 is reciprocated in the dimension B, in the exemplary embodiment illustrated, by rotation of the threaded shaft 31. The shaft 31 is mounted for rotation about an axis D—D which is parallel to the dimension B, and is supported by the frame pieces 24. Operatively engaging the threaded shaft 31 is a conventional ball bearing travelling nut 32, and rotating the shaft 31 is a conventional electric motor, or like power means, 33. The travelling nut 32 is operatively connected to the cross bar 18 by spanning bar 34. Rotation of the shaft 31 about its axis D—D acts through travelling nut 32, spanning bar 34 and cross bar 18 to effect back and forth movement of the presser foot 16 in dimension B.

The apparatus 10 further comprises sensing means for sensing the positions of the blanks 11 in order to ensure that they are properly acted upon. The sensing means are shown only schematically and preferably comprise photoelectric emitting and receiving elements 36, 37 which are stationarily mounted with respect to the surface 15, a light source 38 which is also stationarily mounted with respect to support surface 15, and a photoelectric receiving element 39 which is mounted on the cross bar 18 adjacent the bar 34, and movable with the cross bar 18. The elements 36, 37 are spaced from element 38 approximately the width (that is, the distance in dimension B) of a blank 11.

The apparatus 10 further comprises a connector thread severing structure, shown only schematically by reference numeral 40 in FIG. 1, which is mounted adjacent the photoelectric elements 36, 37, and an unravelling means, which is shown only in part, and schematically, in FIG. 1, and is indicated generally by reference numeral 41. The unravelling means 41 is mounted adjacent the second edge 14 of the blanks 11 while the severing mechanism 40 is mounted adjacent the first edge 13, and the elements 40, 41 are in line with each other (e.g., a line between them is essentially perpendicular to the dimension B, and parallel to the dimension A). The unravelling means 41 cooperates with the blanks 11 through a notch 42 formed in the support surface 15 and extending in the dimension A.

The unravelling mechanism 41 includes a number of different components, including a structure for actually grasping the connector thread 12, which takes the place of an operator's fingers in starting initial unravelling of the thread 12. The exemplary grasping means according to the present invention is shown generally by reference numeral 44 in FIGS. 2–6, and includes first and second brushes 45, 46 mounted on a scissors linkage 47 and pivotal with respect to each other about point 48. The brushes 45, 46 have bristles which engage a loop 12' (see FIGS. 2, 5 and 6 in particular) at the edge 14 of the blanks 11 when in the position illustrated in solid line in FIG. 3. The scissors linkage 47 is mounted for reciprocal movement in dimension A so that the brushes 45, 46 move toward and away from the support 15. The scissors linkage 47 also is mounted so that pivot point 48 thereof is retained in a piece 49 of flat ground stock (bar) with the scissors linkage 47 connected to a lever arm 50 mounted for pivotal movement about stationary axis pivot 51, and having a complimentary lever arm 52. The bar 49 reciprocates in a housing 53 which guides its reciprocal movement. Stationary stops are also mounted on the bar 49 and extend outwardly from it in the same direction as the pivot 48, and are adapted to engage the lower brush 46 to stop its movement in the closed position (solid line in FIG. 3) and in the open position (dotted line in FIG. 3 and the position in FIG. 2). The lower stop can partially be seen in FIG. 2 and is denoted by reference numeral 54, and the upper stop is schematically seen in FIG. 3 and is denoted by reference numeral 55.

The mechanism 44 also includes a friction member for putting a drag on the bar 49 during its movement. The friction member preferably comprises the plate 56 which is spring pressed by spring 57 surrounding support bolts 58 into frictional engagement with a flat surface of the bar 49. The plate 56 or at least the portion thereof engaging the bar 49, is made of a material having a high coefficient of friction, such as asbestos.

The linkage 50–52 is operated by the linear actuator 59. The actuator 59 preferably comprises a pneumatic or hydraulic ram, and includes the piston rod 60 which is pivotally connected at 61 to the lever arm 52. End of travel spring stop 62 is provided at one end of travel of the arm 52, and stationary stop 63 (see FIG. 3) is preferably provided at the opposite end. The spring stop 62 preferably comprises a stationary plate 64 through which a rod 65 having an enlarged, flat free end 66 passes with a spring 67 acting between the head 66 and the plate 64 to resiliently bias the head 66 to the position illustrated in FIG. 2, but allowing the rod 65 to reciprocate through the plate 64 when the head 66 is impacted by lever arm 52.

FIG. 5 shows the position of the mechanism 44 when it has grasped the loop 12' of the connector thread 12 and has moved in dimension A away from the support 15. Once it reaches a position slightly spaced from the support 15, the brushes 45, 46 move to the open position to release the connector thread 12, which returns due to the natural tension forces in the thread 12 which have been released, toward the support 15. If necessary or desired, an air blowing mechanism may be provided mounted on, or adjacent, the mechanism 44 to assist in moving the loop 12' toward the surface 15 once it has been released by the brushes 45, 46.

The whole purpose of the mechanism 44 is to ensure that the loop 12' of the thread 12 is properly positioned when it is engaged by a hook 69. The hook 69 is mounted for reciprocal movement in dimension C, as by a linear actuator 70 (such as a hydraulic or pneumatic cylinder). While the hook 69 is out of the path of movement of the thread 12 when it is moved to the position illustrated in FIG. 5, by the time the brushes have released the thread 12 (FIG. 6), the hook 69 has been moved vertically so that it is in the path of return of the loop 12. The hook 69 engages the loop 12', and then is reciprocated downwardly by the cylinder 70, through a conventional yarn sensor 71 having a central opening therein, into operative association with rollers 72, 73.

The roller 72 is mounted so that the axis of rotation thereof is stationary, while the roller 73 is mounted on a movable axis of rotation, the axis of the roller 73 being linearly moved to the desired position by the pneumatic or hydraulic cylinder 74 which is connected through piston 75 to the axis of the roller 73. A motor 76, connected through a drive belt, chain, or like force transmitting mechanism 77 to the roller 73, effects powered rotation of the roller 73. Once the roller 72, 73 engage the thread 12 with the thread 12 between them, they power the thread 12 so that it completely unravels from the blanks 11 so that the blanks may be separated.

The mechanism 41 includes as a final component thereof a disposal mechanism. One exemplary disposal mechanism is illustrated schematically in FIG. 7, and includes an air tube 78 and hollow cone 79. Once the thread 12 is moved by the hook 69 into a position wherein it is adjacent the tube 78, a blast of air from the tube 78 propels the thread 12 away from the hook 69 and through the cone 79, so that it passes to a disposal site 80. The length of each connecting thread 12, once removed, typically would be about 3 feet.

Figure 8:
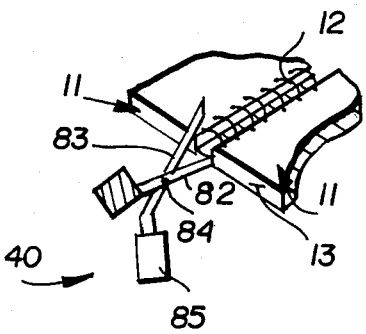
FIG. 8 is a side detailed schematic view of exemplary connector thread severing apparatus according to the present invention.

FIG. 8 schematically illustrates an exemplary connecting thread severing mechanism according to the present invention. Any of a wide variety of conventional severing mechanisms, such as hot wires, can be utilized, but it is preferred to utilize a mechanical cutter such as illustrated in FIG. 8. The mechanical cutter 40 includes a stationary lower blade 82 which is mounted in a groove (not shown) formed in the support surface 15, and a movable upper blade 83. Blade 83 may be pivotted at 84 to the blade 82, and the blade 83 is moved about the pivot point 84 by a linear actuator 85 (such as a solenoid or the like). When the blade 83 is pivotted downwardly into operative association with blade 82 it severs the connecting thread 12. This allows the unravelling mechanism 41 to effect unravelling thereof.

Figure 9:
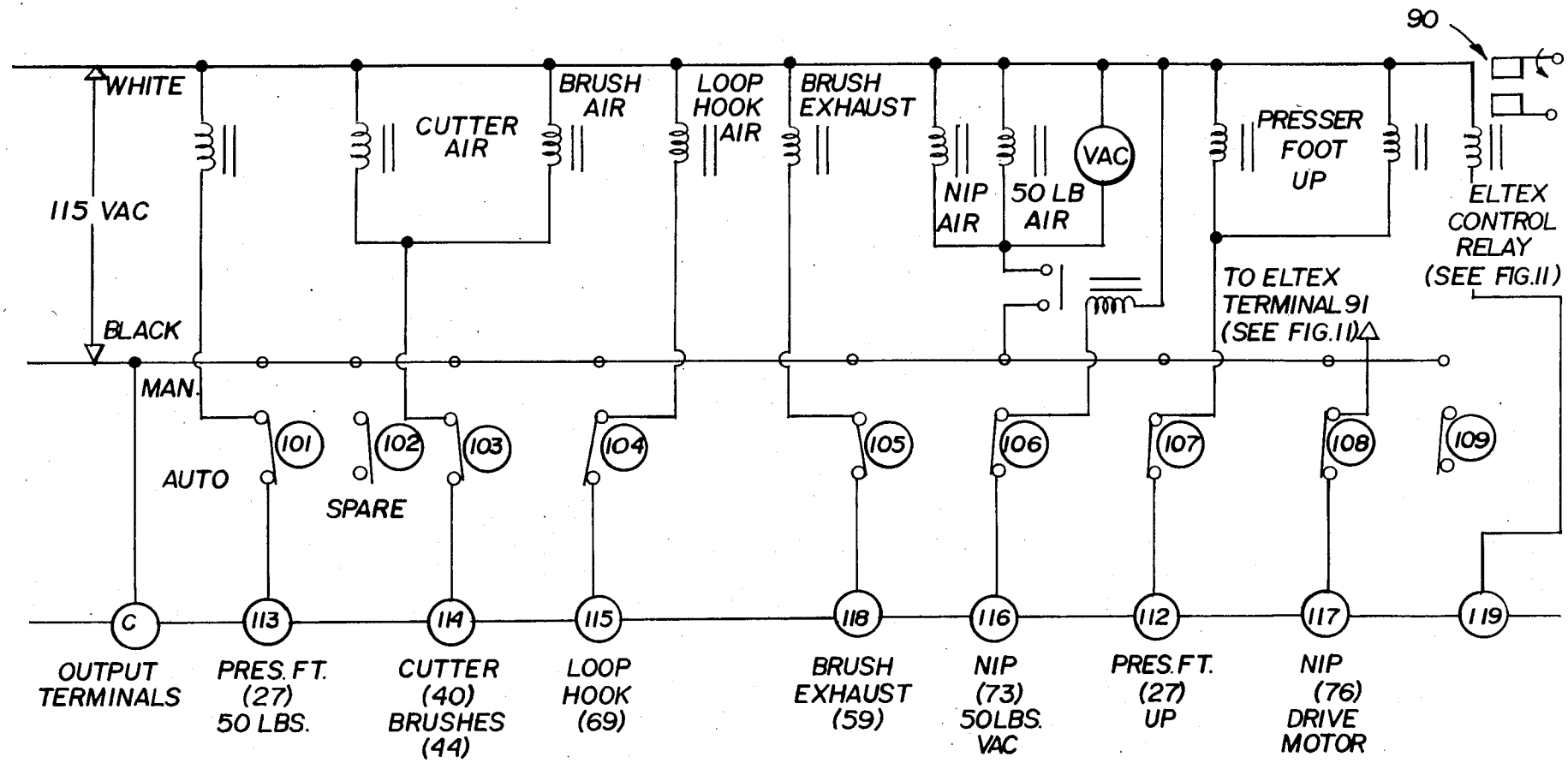
FIGS. 9–11 are electrical schematics illustrating an exemplary interconnection between various control components for the apparatus of FIG. 1.
Figure 10:
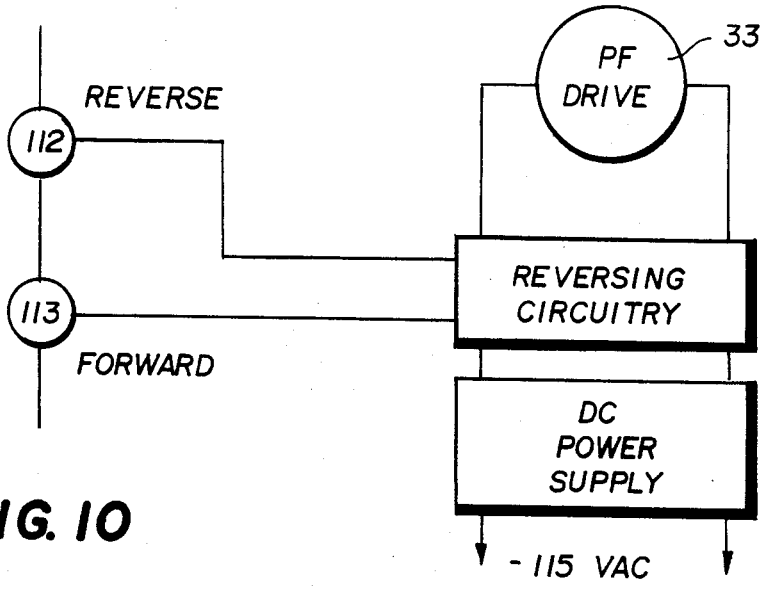
Figure 11:
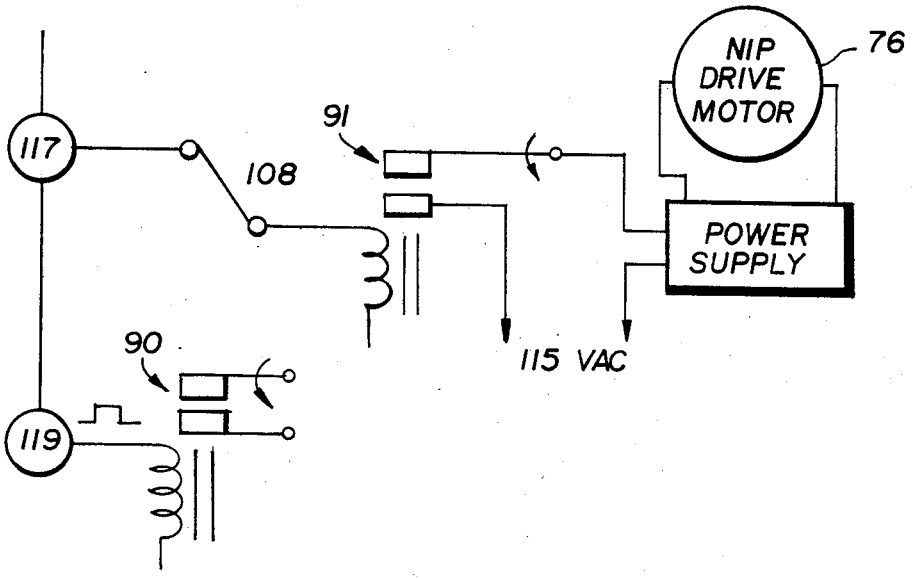

FIGS. 9, 10 and 11 are schematic electrical showings of exemplary control circuitry that may be utilized according to the invention. The coils as illustrated are preferably solenoid operators for pneumatic or hydraulic valves, although in some circumstances the linear actuators heretofore described may be solenoids per se. Most of the elements illustrated in FIGS. 9–11 are self-explanatory, being appropriately labelled, with the elements 101–119 being connections which have been numbered to illustrate the interrelationship between them, with the eltex control relay contacts being illustrated by reference numeral 90, and a cooperating relay having the contacts thereof indicated by reference numeral 91 (see FIG. 11).

Operation

From the position illustrated in FIG. 1, the apparatus 10 is operated by actuation of the motor 33 to rotate the shaft 31 in a direction such that the travelling nut 32 moves toward the blank 11, moving the cross bar 18 and presser foot 16 above the blanks 11. The light source 38 marks the desired position for the presser foot 16, and once photoelectric sensing element 39 moves directly over the light source 38 it effects stoppage of the motor 33 and, through a time delay, initiation of the supply of air to the cylinder 27 so that the plate 17 moves down into contact with a blank 11 on surface 15. Initially a relatively small pressure is applied by the plate 17, e.g., 10 pounds per square inch.

Once the plate 17 is in place, the motor 33 is restarted to rotate the shaft 31 in the opposite direction, so that the plate 17 moves toward the photoelectric sensing elements 36, 37, moving the blanks 11, on the surface 15, with it. Once the relatively open area in which the connector thread 12 is disposed passes between the elements 36, 37, a control signal terminates operation of the motor 33 so that the blanks 11 are stopped in that position. That position, sometimes referred to as a first position, is a position in which the cutter 40 and the unravelling mechanism 41 are directly in alignment with the connector thread 12. At this time, a solenoid operated valve associated with the cylinder 27 supplies further air to it so that a clamping pressure (e.g., 50 pounds per square inch) is provided by the plate 17 to hold the blank 11 which it engages in place. Note that the plate 17 is preferably always positioned with respect to the blanks 11 so that it does not overlap the connecting threads 12.

Once the clamping pressure has been applied, the actuator 85 is actuated to effect movement of the movable cutting blade 83 to serve the connecting thread 12 adjacent edge 13 of blanks 11, and simultaneously the actuator 59 is actuated so that piston rod 60 moves upwardly (see FIG. 2) to pivot the arms 50, 52 about pivot 51 with the brushes 45, 46 in the open position, thus moving the entire scissors linkage 47 to the left in FIG. 2 with the bar 49 sliding in housing 53 During this movement the brushes are gradually moved together until they reach the position illustrated in solid line in FIG. 3, at which point the bristles of both brushes 45, 46 extend through the slot 42 into operative association with the loop 12' of the connector thread 12. At this point, the actuator 59 is again actuated so that the piston rod 60 moves downwardly (in FIG. 2) causing the brushes 45, 46 to move to the position illustrated in FIG. 5 wherein the connector thread 12 starts to unravel. As retraction continues, the lever arm 52 eventually hits the head 66 of spring stop 62, causing the brushes 45, 46 to instantly pop open (see the position in FIG. 6) thus releasing the loop 12'.

Figure 6:
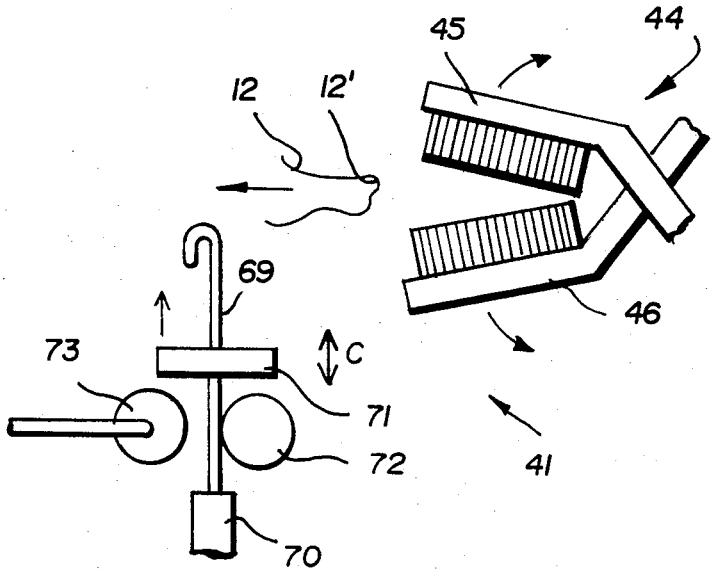
Figure 7:
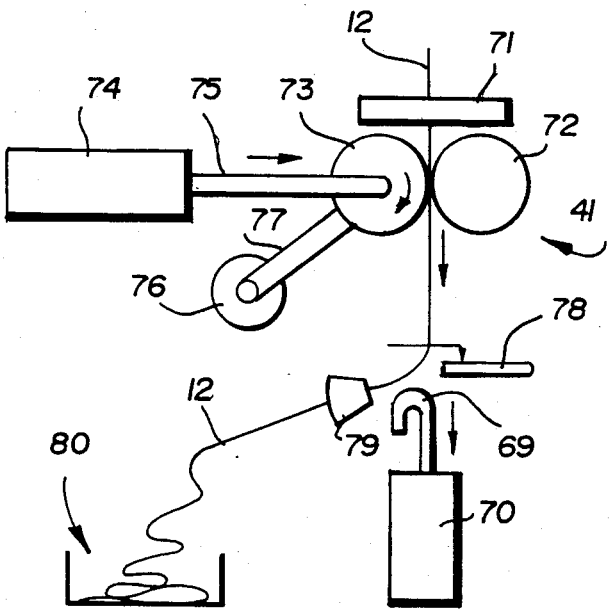

Just prior to, or simultaneously with, movement of the brushes 45, 46 to the position illustrated in FIG. 6, the supply of air to the cylinder 70 is controlled so that the hook 69 moves to the position illustrated in FIG. 6, at which position it catches the loop 12' as the thread 12 moves back toward the blanks 11. The hook 69, with thread 12 in tow, moves through the yarn sensor 71 which, after a delay, provides a control signal actuating a linear actuator 74 to move the piston 75 to the right (as seen in FIGS. 6 and 7) so that the rollers 73, 72 operatively engage with the thread 12 therebetween. The motor 76 powers the roller 73 so that the thread 12 is pulled between the rollers 72, 73 and unravelled from the blanks 11. The lead part of the thread 12 (namely the loop 12') is blown by air from the tube 78 through the hollow cone 79 into the disposal area 80, and the unravelling process effected by the rollers 72, 73 continues until all of the thread 12 is in the disposal site 80. At this time, the actuator 74 is controlled so that the roller 73 moves back to the position illustrated in FIG. 6, the actuator 27 is controlled to move the presser foot 16 upwardly so that the plate 17 no longer is in engagement with the blank 11, and the entire process is repeated.

Note that once the hook 69 with thread 12 moves through the yarn sensor 71, the contacts 91 are momentarily closed, which closes the terminals 90 and starts the nip drive motor 76. As long as yarn travels through the sensor 71 the terminals 90 remain closed, but once all the yarn has passed therethrough the sensor 71 controls the components so that the contacts 90 open again.

Since the operation according to the present invention is entirely automatic, of course suitable conventional computer control components may be utilized to control the various operations, including utilizing suitable software.

It will be thus be seen that according to the present invention an effective method and apparatus have been provided for the automatic separation of textile blanks such as knit sport shirt collars. While the invention has been herein shown and described in what is presently conceived to be the most practical and preferred embodiment, it will be apparent to those of ordinary skill in the art that many modifications may be made thereof within the scope of the appended claims, which claims are to be given an interpretation so as to encompass all equivalent methods and apparatus.

We claim:

1. Apparatus for automatically separating two textile blanks connected together by connector threads, which threads extend generally in a first dimension, the apparatus comprising:

a support surface on which the textile blanks are disposed;

textile blank engaging means;

means for mounting said textile blank engaging means for back and forth movement with respect to said support surface in a second dimension generally perpendicular to said first dimension;

means for mounting said textile blank engaging means for movement with respect to said support in a third dimension, generally perpendicular to said first dimension;

means for moving said textile blank engaging means in said second dimension;

means for moving said textile blank engaging means in said third dimension;

sensing means for sensing the position of said connector threads between textile blanks;

cutting means responsive to said sensing means for cutting said connector threads; and unravelling means for engaging the cut connector threads and unravelling them from the textile blanks so that the blanks are separated.

2. Apparatus as recited in claim 1 wherein said textile blank engaging means comprises a presser foot, and means for applying a significant pressure to said presser foot so that once said presser foot engages a textile blank the presser foot tightly holds the presser blank against said support surface.

3. Apparatus as recited in claim 2 wherein said means for mounting said presser foot for movement in said third dimension comprises: a cross bar disposed vertically above and generally parallel to said support surface and substantially spanning the width thereof; means for supporting said cross bar at opposite ends thereof; and guide means operatively interconnecting said presser foot and said cross bar for guiding reciprocal movement of said presser foot in said third dimension.

4. Apparatus as recited in claim 3 wherein said means for moving said presser foot in said third dimension comprises a linear actuator mounted on said cross bar and operatively connected to said presser foot.

5. Apparatus as recited in claim 4 wherein said means for mounting said presser foot for movement in said second dimension and said means for supporting said cross bar collectively comprise first and second guide rods extending parallel to each other and in said second dimension, and mounted on opposite sides of said support surface, and guide blocks operatively mounted to said cross bar and receiving said guide rods therein.

6. Apparatus as recited in claim 5 wherein said means for moving said presser foot in said second dimension comprises a threaded shaft extending parallel to said guide rods, a travelling nut operatively receiving said threaded shaft, power means for rotating said threaded shaft, and means for interconnecting said travelling nut and said cross bar.

7. Apparatus as recited in claim 6 wherein said sensing means comprises photoelectric sensing means including a photoelectric sensing means component operatively mounted to said cross bar.

8. Apparatus as recited in claim 1 wherein said cutting means comprises a moveable mechanical cutting element and a linear actuator for effecting movement of said cutting element, said actuator and cutting element being disposed adjacent an edge of said support surface which extends generally in said second dimension.

9. Apparatus as recited in claim 8 wherein said unravelling means comprises: means for grasping a loop of said connector threads adjacent an opposite edge of said support surface from the edge at which said mechanical cutting means is disposed, for grasping a connector thread and unravelling it by pulling it away from said blanks; roller means for engaging the connector thread when released by said grasping means and completing unravelling thereof; and disposal means for disposing of the connector thread when it is unravelled by said roller means.

10. Apparatus as recited in claim 9 further comprising hook means for operatively engaging the connector thread when released by said grasping means and moving the connector thread into operative association with said roller means.

11. Apparatus as recited in claim 10 wherein said grasping means comprises a pair of brushes mounted on a scissors linkage for pivotal movement toward and away from each other, the linkage mounted for reciprocal movement toward and away from said support surface in said first dimension.

12. Apparatus for automatically separating two textile blanks connected together with connector thread, which thread extends generally in a first dimension, the apparatus comprising:

advancing means for advancing the textile blanks in a second dimension generally perpendicular to said first dimension, said advancing means having first and second sides disposed in said first dimension;

cutting means disposed on the first side of said advancing means, for automatically cutting the connector thread at that side; and unravelling means mounted at said second side of said advancing means, said unravelling means comprising means for automatically grasping a connector thread at said second side, and effecting unravelling and disposal thereof, said unravelling means comprising first and second brushes; a scissors linkage for mounting the first and second brushes for movememnt between a first position wherein they grasp a connector thread therebetween, and a second position wherein they release the connector thread; and means for mounting said scissors linkage for reciprocal linear movement toward and away from the textile blanks.

13. Apparatus as recited in claim 12 wherein said unravelling means further comprises hook means for hooking the connector thread, and roller means mounted in operative association with said hook means, and means for moving said hook means so that after said hook means engages the connector thread it moves it into operative association with said roller means.

14. Apparatus as recited in claim 13 wherein said means for moving said hook means comprises means for moving said hook means into the path of movement of the connector thread when released by said brushes.

15. Apparatus as recited in claim 13 further comprising a yarn sensor having a central opening therein, the yarn sensor positioned with respect to said roller means and said hook means so that when said hook means moves from a first to a second position thereof for hooking the connector thread it passes through said central opening in said yarn sensor, and when it moves from said second to said first position thereof moves the connector thread through said yarn sensor and into operative association with said roller means.

16. A method for automatically separating a pair of textile blanks which are connected by a connector thread, the connector thread extending generally in a first dimension, and the textile blanks having first and second sides which are opposite from each other and extend in a second dimension, generally perpendicular to the first dimension, the method comprising the steps of:

(a) automatically operatively engaging the textile blanks and moving them into a first position wherein the connector thread is properly positioned;

(b) automatically, essentially simultaneously, severing the connecting thread at a first side of the textile blanks, while grasping the connector thread at a second side of the textile blanks;

(c) automatically moving the grasped connector thread generally in the first dimension away from the textile blanks; and (d) automatically releasing the grasp on the connector thread and then operatively engaging the connector thread and effecting complete unravelling and automatic disposal thereof.

17. A method as recited in claim 16 wherein step (a) is practiced by utilizing a presser foot and a support surface, the textile blanks being disposed on the support surface, and is practiced by: automatically moving the presser foot vertically away from the support surface; moving the presser foot in the second dimension until it overlies a desired textile blank; moving the presser foot downwardly into operative association with the textile blank and pressing it against the support surface; and moving the presser foot, and the textile blanks along with it, in the second dimension to said first position.

18. A method as recited in claim 17 wherein steps (b)–(d) are practiced by grasping the connector thread with a pair of brushes, moving the thread held by the brushes away from the textile blanks, moving the brushes away from each other to release the connector thread; engaging the released thread with a hook; and with the hook, moving the connector thread into operative association with rollers which engage and unravel the thread.

19. A method as recited in claim 18 wherein step (b) is practiced by automatically moving a mechanical cutter into operative association with the connector thread.

20. A method as recited in claim 16 wherein steps (b)–(d) are practiced by grasping the connector thread with a pair of brushes, moving the thread held by the brushes away from the textile blanks, moving the brushes away from each other to release the connector thread; engaging the released thread with a hook; and, with the hook, moving the connector thread into operative association with rollers which engage and unravel the thread.

21. A method for automatically separating a pair of textile blanks connected together by connecting thread extending generally in a first dimension, the textile blanks having opposite first and second sides which are generally disposed in a second dimension, perpendicular to the first dimension, and wherein the method is practiced utilizing a presser foot and a support surface on which the textile blanks are supported, the method comprising the steps of:

(a) automatically moving the presser foot vertically away from the support surface; moving the presser foot in the second dimension until it overlies a desired textile blank; moving the presser foot downwardly into operative association with the textile blank and pressing it against the support surface; and moving the presser foot, and the textile blanks along with it, in the second dimension to a first position;

(b) automatically severing the connector thread while the blank is at the first position; and (c) automatically unravelling the connector thread while the blank is at the first position.

22. A method as recited in claim 21 wherein steps (b) and (c) are practiced by: grasping the connector thread with a pair of brushes; moving the thread held by the brushes away from the textile blanks; moving the brushes away from each other to release the connector thread; engaging the released thread with a hook; and with the hook moving the connector thread into operative association with rollers which engage and unravel the thread.

23. A method as recited in claim 21 wherein the textile blanks are knit sport shirt collars.

24. A method as recited in claim 21 wherein between step (a) and steps (b) and (c), a clamping force is applied by the presser foot to clamp the blank tightly and unmovably to the support surface.

* * * * *